US006638010B2

(12) United States Patent
Conrad et al.

(10) Patent No.: US 6,638,010 B2
(45) **Date of Patent: *Oct. 28, 2003**

(54) GAS FRICTION PUMP

(75) Inventors: Armin Conrad, Herborn (DE); Heinrich Lotz, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 72 days.

This patent is subject to a terminal disclaimer.

(21) Appl. No.: 10/054,154

(22) Filed: Nov. 13, 2001

(65) Prior Publication Data

US 2002/0064451 A1 May 30, 2002

(30) Foreign Application Priority Data

Nov. 13, 2000 (DE) ..... 100 56 144

(51) Int. Cl.[7] ..... F04D 19/04

(52) U.S. Cl. ..... 415/90; 415/143; 417/423.4

(58) Field of Search ..... 415/90, 145, 116, 415/143, 177, 199.5, 72, 73, 199.4, 176; 417/423.4

(56) References Cited

U.S. PATENT DOCUMENTS

| | | | | | |
|---|---|---|---|---|---|
| 3,969,039 | A | * | 7/1976 | Shoulders | 417/244 |
| 4,830,584 | A | * | 5/1989 | Mohn | 417/356 |
| 5,445,502 | A | * | 8/1995 | Itou et al. | 417/203 |
| 5,611,660 | A | * | 3/1997 | Wong et al. | 415/90 |
| 5,664,935 | A | * | 9/1997 | Nishiuchi et al. | 415/90 |
| 6,106,223 | A | * | 8/2000 | Leyshon | 415/90 |
| 6,193,461 | B1 | * | 2/2001 | Hablanian | 415/90 |
| 6,524,060 | B2 | * | 2/2003 | Conrad et al. | 415/90 |

* cited by examiner

*Primary Examiner*—Edward K. Look
*Assistant Examiner*—J. M. McAleenan
(74) *Attorney, Agent, or Firm*—Sidley Austin Brown & Wood, LLP

(57) ABSTRACT

A gas friction pump including a housing (1) having a suction opening (2) and a gas outlet opening (3), rotor (12) and stator (14) components arranged in the housing (1) for delivery of gases and for obtaining a pressure ratio; and an additional, at least one-stage, concave pump unit (20, 30, 40) provided at a side of the suction opening (2) and having a gas delivery structure, with the additional pump unit (20, 30, 40) being so formed that gas delivery takes place in a radial direction, and with rotor components (21, 31, 41) of the additional pump unit (20, 30, 40) being supported on the same rotor shaft (4) as the rotor components of the pump itself.

5 Claims, 3 Drawing Sheets

GAS FRICTION PUMP

BACKGROUND OF THE INVENTION

1. Field of the Invention

The present invention relates to a gas friction pump including a housing having suction and gas outlet openings, and rotor and stator components arranged in the housing for delivering gases and for obtaining a pressure ratio.

2. Description of the Prior Art

For delivery of gases, gas friction pumps of different types are used. Their operation is based on transmission of pulses from movable walls to gas particles. In this way, a gas flow in a predetermined direction is achieved. Gas friction pumps, which operate in a pressure range in which the mean free path length of gas molecules, i.e., the mean travel path of the gas molecules, is large in comparison with the pump dimensions, are called molecular pump.

A first gas friction pump was described by Gaede (Ann. Phys. 41, 1913, p. 337). Further technical developments, with retaining the basic principle, were made by Siegbahn (Arch. Math. Ast. Phys. 30B, 1943), Holweck (Comptes Reduc Acad. Science 177, 1923, p. 43), and Becker (Vakuum Technik 9/10, 1966). The molecular pump of Becker is known as a turbomolecular pump, and it has found wide application in science and technology. The present invention is based on the turbomolecular pump.

The drawbacks, which characterize the conventional turbomolecular pumps and the elimination of these drawbacks according to the present invention, are applicable for other gas friction pumps as well.

The suction capacity of a turbomolecular pump essentially depends on the inlet cross-section of the suction flange, on the mean circumferential speed of the blade crowns of the rotor blades adjacent to the pump-out space, and on the pump structure. In addition, the suction capacity depends on the internal structure of the pump, gradation of the pressure ratio, and the suction capacity or speed between separate pump stages. Lastly, but not the least, the suction capacity depends on which part of the pump or the pump combination works against the atmosphere.

These characteristics can be optimally established, and the rotational speed can be increased, within the area of technical possibilities, to an extent that the largest portion of the molecules, which are collected on the blade crowns, can be pumped out. However, these molecules do not include all of the molecules entering the inlet cross-section of the suction flange. A large area of this surface is formed by the end surface of the rotor which does not have a gas delivery structure. Even when the blade crown is increased further, at the expense of the rotor end surface, the suction capacity is still limited by the cross-section of the suction flange. The quantity of the pumped molecules depends on how many molecules reach the gas delivery structure of the inlet stage. Even of that quantity which reaches the gas delivery structure, a definite number of molecules is rebound and, therefore, is not acquired by the delivery mechanism.

Accordingly, an object of the present invention is to provide a gas friction pump having a noticeably greater suction capacity than conventional pumps, with the same cross-section of the suction flange as the conventional pumps.

SUMMARY OF THE INVENTION

This and other objects of the present invention, which will become apparent hereinafter, are achieved by providing an additional, at least one-stage, concave pump unit provided at a side of the suction opening and having a gas delivery structure, with the additional pump unit being so formed that gas delivery takes place in a radial direction, and with rotor components of the additional pump unit being supported on the same rotor shaft as the rotor components of the gas friction pump itself.

With the additional pump unit according to the present invention, which has at least one stage but may have several stages, the largest part of the molecules, which are rebound of a gas delivery structure, are reflected onto another region of this structure and, thus, still reach the delivery mechanism. This effect is achieved by providing an additional pump unit having a concave shape, which enables delivery of molecules in the radial direction. As a result, the reflected or rebound molecules are recaptured and are delivered further. This substantially increases the suction capacity with the same suction cross-section.

A further advantage of the present invention consists in that the concave suction space provides room for components of different recipients, permitting to achieve an effective pumping action.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
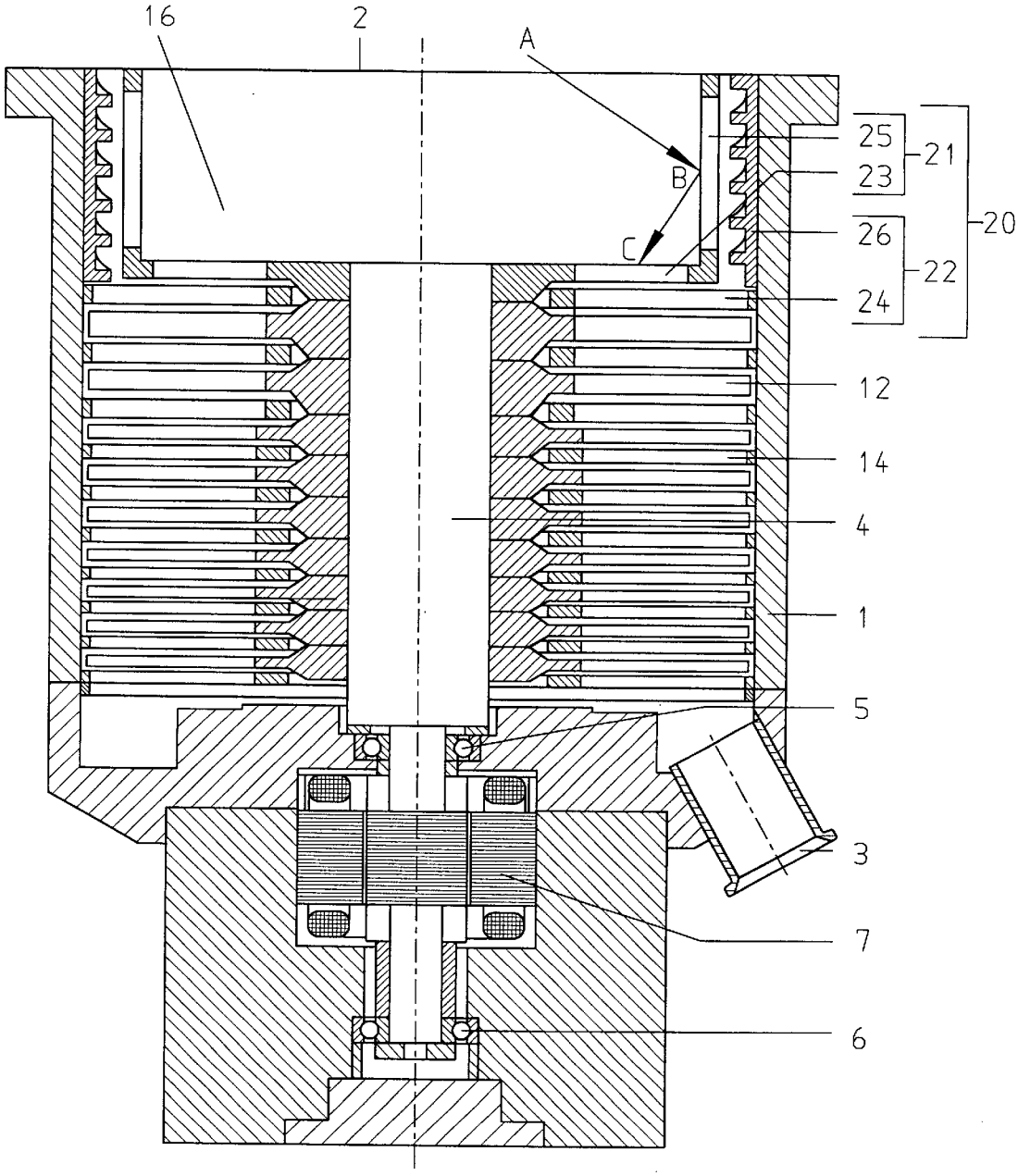
FIG. 1 a cross-sectional view of a first embodiment of a gas friction pump according to the present invention.
Figure 2:
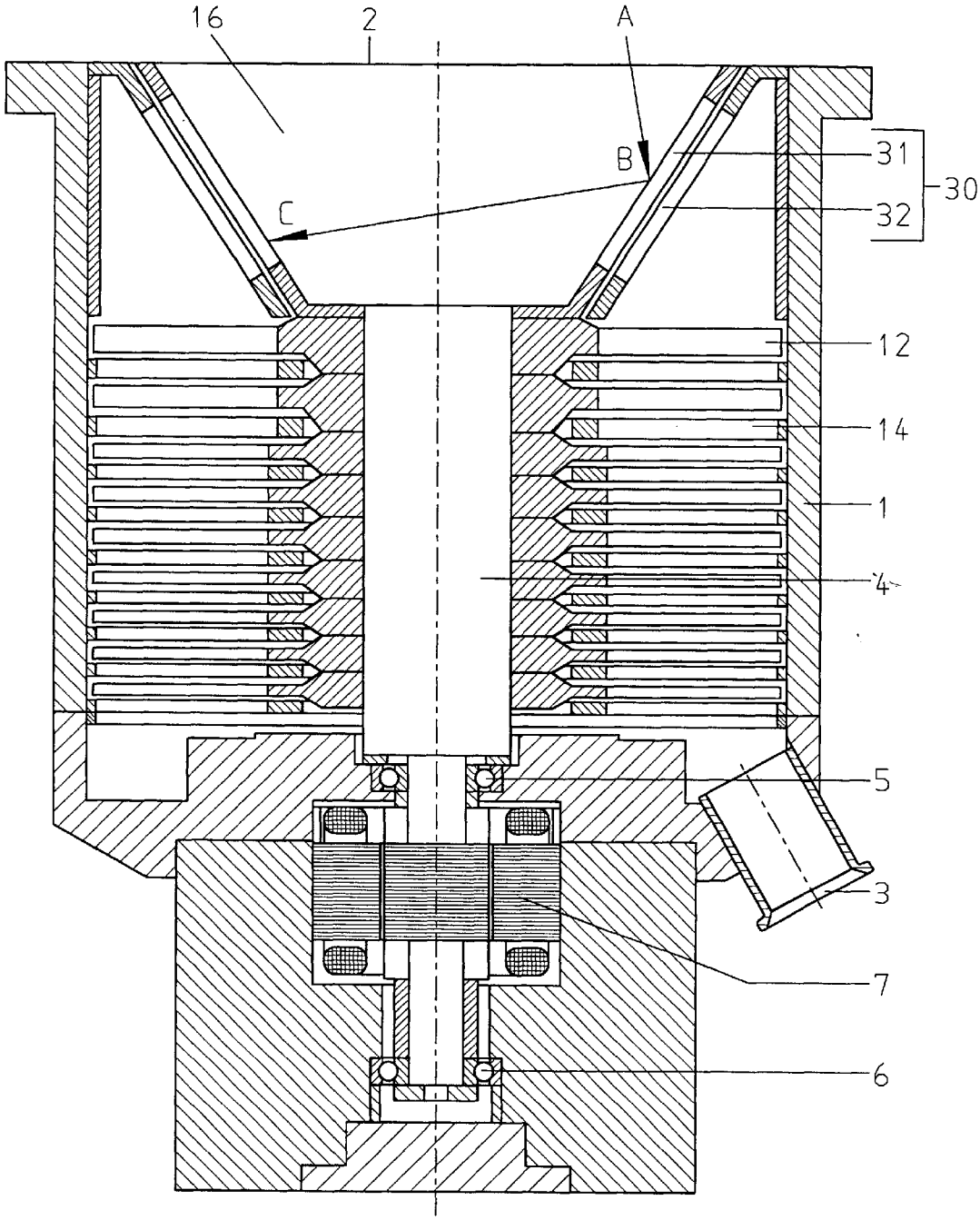
FIG. 2 a cross-sectional view of a second embodiment of a gas friction pump according to the present invention.
Figure 3:
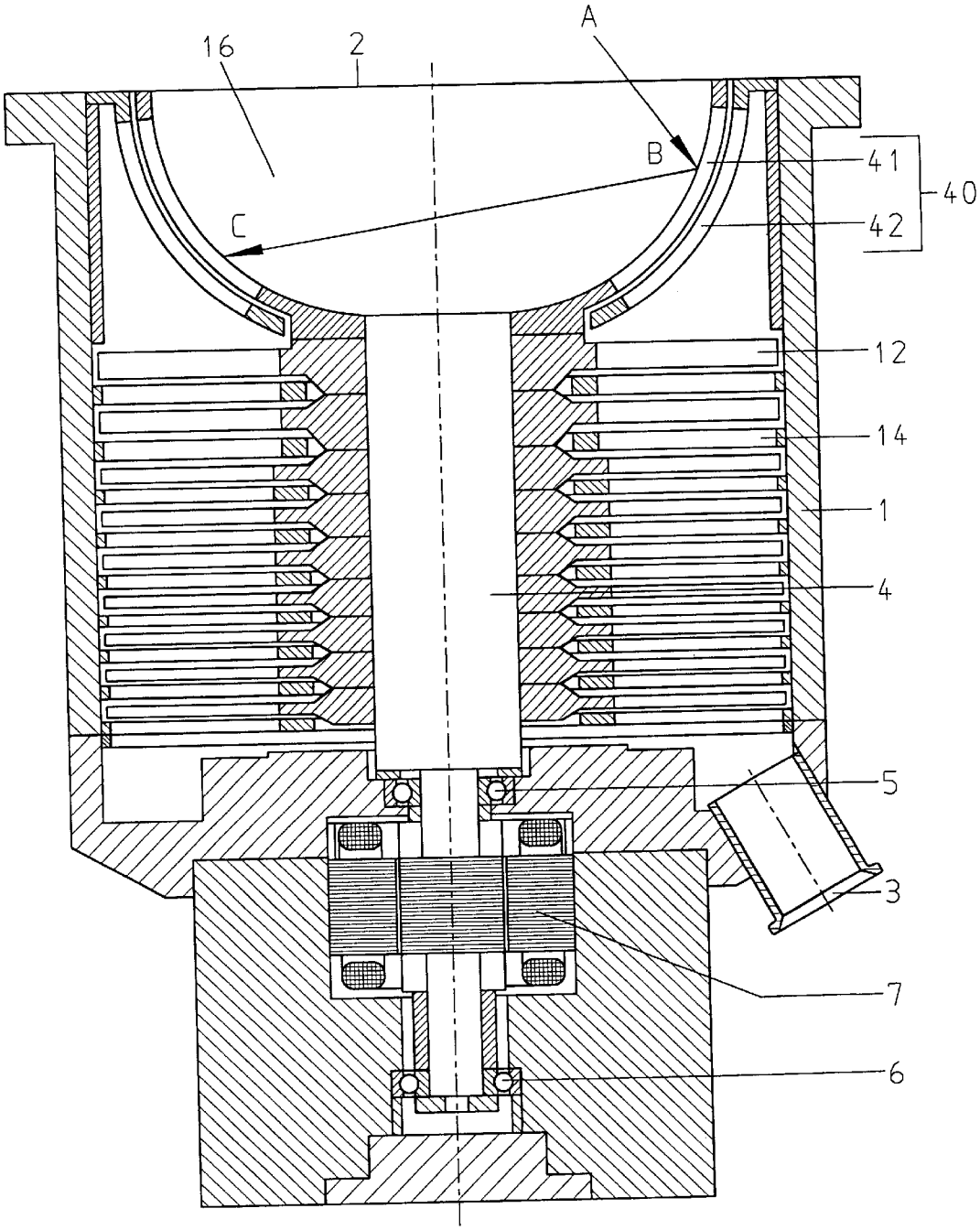
FIG. 3 a cross-sectional view of a third embodiment of a gas friction pump according to the present invention.

A gas friction pump according to the present invention, which is shown in FIGS. 1–3, includes a housing 1 having a suction opening 2 and a gas outlet opening 3, a rotor shaft 4 located in the housing 1 and supported in bearings 5 and 6, and a motor 7 for driving the rotor shaft 4. A plurality of rotor discs 12 of a turbomolecular pump is mounted on the rotor shaft 4. The rotor discs 12 have a gas delivery structure and cooperate with stator discs 14, which likewise have a gas delivery structure, to obtain a pumping effect.

As shown in FIG. 1, in the first embodiment of the inventive gas friction pump, an additional pump unit 20 is provided at the side of the suction opening 2. The pump unit 20 is formed as a one-stage unit and has a pot shape. The rotor components 21 and the stator components 22 are formed, respectively, of cylindrical elements 25, 26 and bottom elements 23, 24. Both the rotor components 21 and the stator components 22 are provided with a gas delivery structure.

In the embodiment of an inventive gas friction pump shown in FIG. 2, an additional pump unit 30 has a shape of a cone and includes rotor and stator components 31 and 32.

In the embodiment of an inventive gas friction pump shown in FIG. 3, the additional pump unit 40 has a shape of spherical cup and includes rotor and stator components 41 and 42, respectively.

Entering gas molecules A are partially collected by the gas delivery structure of the rotor components 21, 31, 41, respectively, and are delivered further, with a part of the molecules being reflected at a respective point B. A greater part of the reflected molecules accumulates at a respective point C and is pumped further or is reflected again. As a result, a substantial portion of the molecules, which were reflected, is again delivered to the conveying mechanism.

In the suction space 16, which is formed in the additional pump unit 20, 30, 40, components of a receiver for evacuating and/or degasing can be arranged. These components are surrounded by pumping active structures and are subjected to a very effective pumping process.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claimed is:

1. A gas friction pump, comprising a housing (1) having a suction opening (2) and a gas outlet opening (3); rotor (12) and stator (14) components arranged in the housing (1) for delivery of gases and for obtaining a pressure ratio; a rotor shaft (4) located in the housing for supporting the rotor components (12); and an additional, at least one-stage, concave pump unit (20, 30, 40) provided at a side of the suction opening (2) and having a gas delivery structure, the additional pump unit (20, 30, 40) being so formed that gas delivery takes place in a radial direction, and rotor components (21, 31, 41) of the additional pump unit (20, 30, 40) being supported on the rotor shaft (4) of the gas friction pump.

2. A gas friction pump according to claim 1, wherein the additional pump unit (20, 30, 40) provides for gas delivery also in an axial direction.

3. A gas friction pump according to claim 1, wherein the rotor components (21) and stator components (22) of the additional pump unit (20) have a pot shape.

4. A gas friction pump according to claim 1, wherein the rotor components (31) and stator components (32) of the additional pump unit (30) have a shape of a truncated cone.

5. A gas friction pump according to claim 1, wherein the rotor components (41) and stator components (42) of the additional pump unit (40) have a shape of a spherical cup.

* * * * *